US007989734B2

(12) United States Patent
Lee

(10) Patent No.: US 7,989,734 B2
(45) Date of Patent: Aug. 2, 2011

(54) HAIR STYLING APPLIANCE

(75) Inventor: Ignatius Kwang Chian Lee, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 862 days.

(21) Appl. No.: 11/993,610

(22) PCT Filed: Jun. 23, 2006

(86) PCT No.: PCT/IB2006/052049

§ 371 (c)(1), (2), (4) Date: Dec. 21, 2007

(87) PCT Pub. No.: WO2007/000700

PCT Pub. Date: Jan. 4, 2007

(65) Prior Publication Data

US 2010/0154817 A1 Jun. 24, 2010

(30) Foreign Application Priority Data

Jun. 29, 2005 (EP) ..... 05105776

(51) Int. Cl.

| | |
|---|---|
| ***A45D 1/04*** | (2006.01) |
| ***A45D 2/12*** | (2006.01) |
| ***A45D 2/40*** | (2006.01) |

(52) U.S. Cl. ..... 219/222; 219/225; 132/224; 132/269

(58) Field of Classification Search ..... None
See application file for complete search history.

(56) References Cited

U.S. PATENT DOCUMENTS

| | | | | |
|---|---|---|---|---|
| 4,259,566 | A | 3/1981 | Kobayashi | |
| 5,868,146 | A * | 2/1999 | Henninger et al. | 132/232 |
| 6,223,753 | B1 | 5/2001 | Lo | |
| 6,354,305 | B1 * | 3/2002 | Janouch et al. | 132/232 |
| 2006/0207625 | A1 * | 9/2006 | Chan | 132/224 |

FOREIGN PATENT DOCUMENTS

| | | | |
|---|---|---|---|
| WO | 03039290 | A2 | 5/2003 |
| WO | 2005020742 | A1 | 3/2005 |

* cited by examiner

*Primary Examiner* — Joseph M Pelham

(57) ABSTRACT

To prevent over-heating and moisture loss of hair being styled by the influence of heat and pressure such as by a straightener, a hair styling appliance with two clamping members at least one of which includes a heating member for clamping hair to be styled. At least one of the clamping members includes a cooling member, seen in operating direction, is behind the heating member. During the straightening process, the hair will be straightened by the hot plates and then subsequently be cooled down by the cold plates.

7 Claims, 3 Drawing Sheets

HAIR STYLING APPLIANCE

The present invention relates to a hair styling appliance with two clamping members, at least one of which comprising a heating member, for clamping hair to be styled. In particular, it relates to hair styling appliances such as straighteners, crimpers and curlers.

Hair styling appliances are currently used e.g. for straightening, crimping or curling hair in the professional as well as the domestic domain. They rely on the principle of simultaneously heating the hair or locks of hair and pressing it or them into a determined shape.

Examples for known hair styling appliances are described in U.S. Pat. No. 6,223,753 B1. They typically include two clamping members, two heating members, two bases, and two styling members. The two heating members are respectively fixed on an inner side of a front portion of the upper and the lower clamping member, and the two bases are respectively fixed on the two heating members for connecting with the upper and the lower styling member. A plurality of styling members with different surfaces for straightening or crimping are provided and can be removably attached to the bases. The styling members are made of ceramic to avoid harming the hair. By having ceramic styling members, infra-red light between 6000 nm and 40000 nm is produced for heating the hair. It is supposed that infra-red light of this wavelength range is not harming the hair, but has a protective function in that it lets the inner organization of hairs get more nourished.

It is an object of the present invention to provide a further possibility to avoid harming the hair while styling it with a hair styling appliance.

This object is achieved by a hair styling appliance with clamping members, at least one of which comprising a heating member, for clamping hair to be styled, wherein at least one of the clamping members comprises a cooling member, which cooling member is provided, seen in operating direction, behind the heating member.

The hair styling appliance according to the invention provides the possibility during styling operation to style the hair as known with the one or more heating members and to subsequently cool down the heated and styled hair with help of the one or more cooling members. This has not only the advantage of preventing over-heating and moisture loss of the hair by rapidly cooling it, thus being caring and not damaging to the hair. It also has the further advantages of making the styling operation faster, as the hair will be cool and ready for the next cycle without the need to wait for the hair to cool down. And the styling itself is more permanent, because the rapid cooling after the styling by heating and pressing provides a more permanent set of the hair.

The cooling subsequent to the heating of the hair can be applied either to hair styling appliances with ceramic members as described in U.S. Pat. No. 6,223,753 B1 or to conventional hair styling appliances without ceramic members.

To further improve the heating as well as the cooling effect of the hair styling appliance according to the present invention, all clamping members comprise a heating member and a cooling member, the heating members and the cooling members facing each other respectively, when clamping hair to be styled. This is particularly useful, when styling thick hair or large locks of hair.

Preferably, at least one clamping member comprises more than one heating member and/or one cooling member to enhance the styling process. Advantageously, the heating and cooling members are arranged alternatingly in operating direction. Thus, a further heating cycle follows immediately a cooling cycle. This makes the styling even faster.

In preferred embodiments of the present invention, the cooling member comprises a Peltier element. The Peltier element has cooling characteristics that are suitable for providing cooling in a cooling member of a hair styling appliance, and can easily be integrated into a hair styling appliance due to its relatively small size and weight. Besides, Peltier elements can be dimensioned to allow either for mains operation or for battery operation.

A preferred kind of coolers based on the Peltier effect are so-called thermal electric coolers (TEC). TECs usually have a cold and a hot side. Particularly compact hair styling appliances can be achieved, if the cooling member is the cold side of a TEC and the heating member is the hot side of a TEC.

Preferably, at least one of the clamping members comprises a platen being in thermal contact with the cooling member and/or heating member. The platen may be useful for providing a homogeneous temperature over the whole area of the cooling member or heating member facing the hair to be styled.

Advantageously, at least one of the clamping members comprises a styling member. Especially for crimping hair, it has been shown to be useful to define the crimp with help of a styling member. Preferably, the styling member is removable and several styling members are provided for different kinds of crimp.

Preferably, the cooling member has a controllable cooling rate to choose the temperature depending on the thickness and sensitivity of the hair as well as depending on the styling operation, e.g. straightening, crimping or curling. Advantageously, the heating rate is controllable as well.

In preferred embodiments, at least one of the clamping members comprises a heating member and a cooling member, the heating member and the cooling member being separated by an insulating member to avoid a negative impact of the heating member on the cooling member and vice-versa.

A detailed description of the invention is provided below. Said description is provided by way of a non-limiting example to be read with reference to the attached drawings in which:

FIG. 1*a* shows a schematic side view of a hair straightener;

FIG. 1*b* shows a schematic top view of the lower clamping member of the hair straightener of FIG. 1*a;*

FIG. 1*c* shows a schematic cut through the clamping member of FIG. 1*b;*

Figure 3:
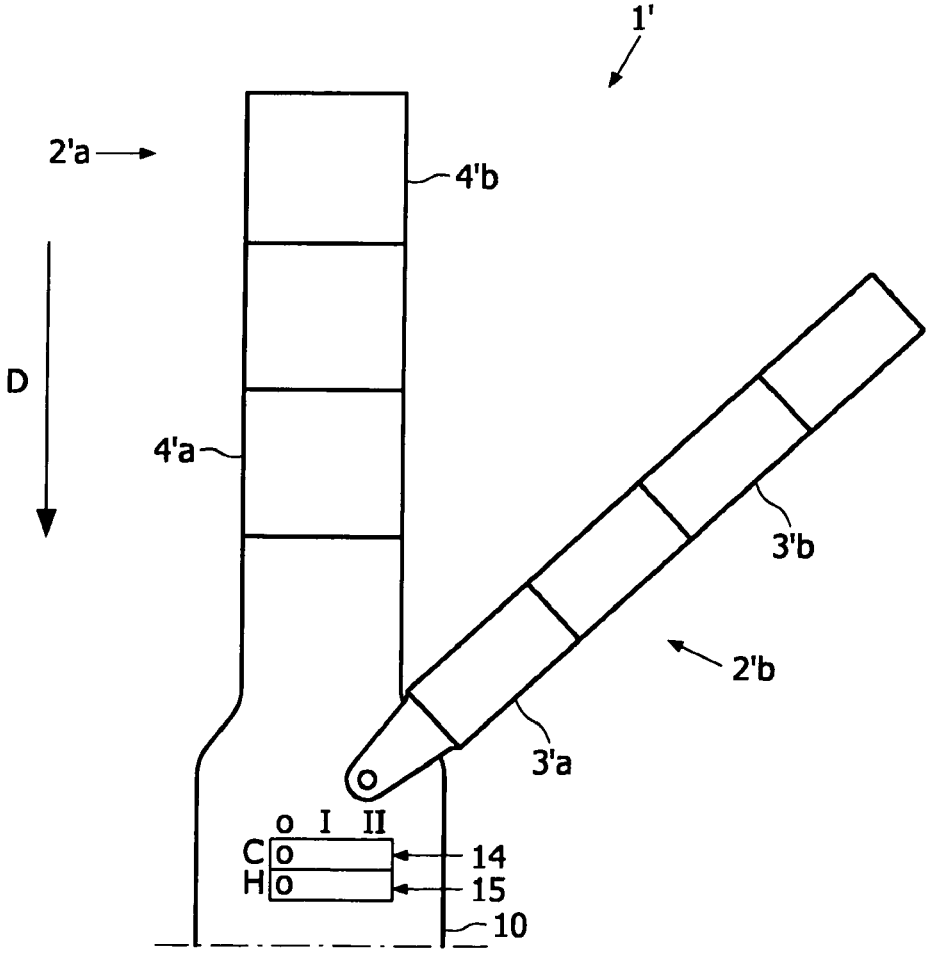
FIG. 3 shows a schematic side view of a hair curler.
Figure 4A:
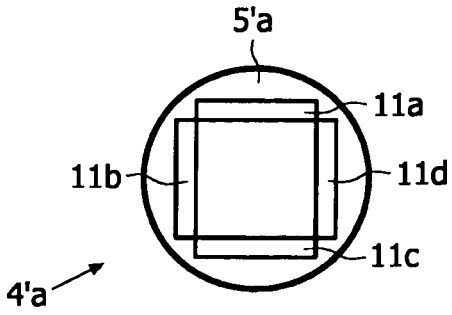
Figure 5:
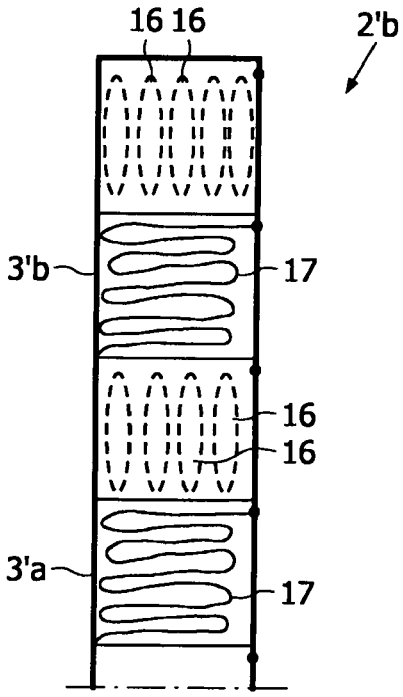

FIGS. 4*a,b,c* show schematically cuts of the fixed clamping member of the hair curler of FIG. 3 with various embodiments of cooling members; and FIG. 5 shows a schematic view of the movable clamping member of the hair curler of FIG. 3.

Figure 1A:
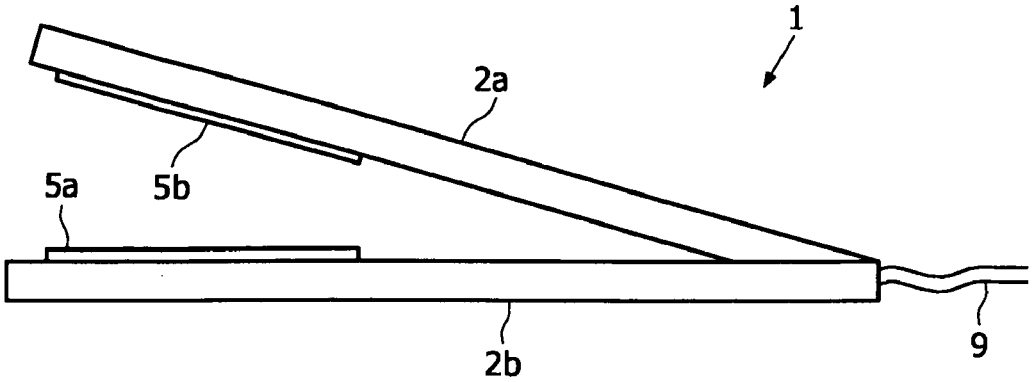

FIG. 1*a* shows schematically a hair straightener 1. The hair straightener 1 includes two clamping members 2*a,b* pivotally attached to each other, such that they can be opened to introduce a lock of hair to be straightened between them, and be closed to heat and press the hair between platens 5*a,b*. FIG. 1*a* shows the hair straightener 1 being open.

The platens 5*a,b* are in thermal contact with heating members facing each other and provided inside the clamping members 2*a,b*. Next to the heating members are provided cooling members inside both clamping members 2*a,b*, facing each other, too. The cooling members are covered by platens as well that are hidden by platens 2*a,b* in FIG. 1*a*.

The straightener 1 of FIG. 1*a* is main operated and relied to power supply by lead 9.

It will be noted that the clamping members 2*a,b* need not necessarily by pivotally attached to each other at their ends. They could also be pivotally attached to each other more in the middle, thus dividing the clamping members 2*a,b* into a styling part and a grip part. The clamping members 2*a,b* may also be attached to a housing containing for example a battery pack or wiring or a control unit for the heating members and cooling members.

Figure 1B:
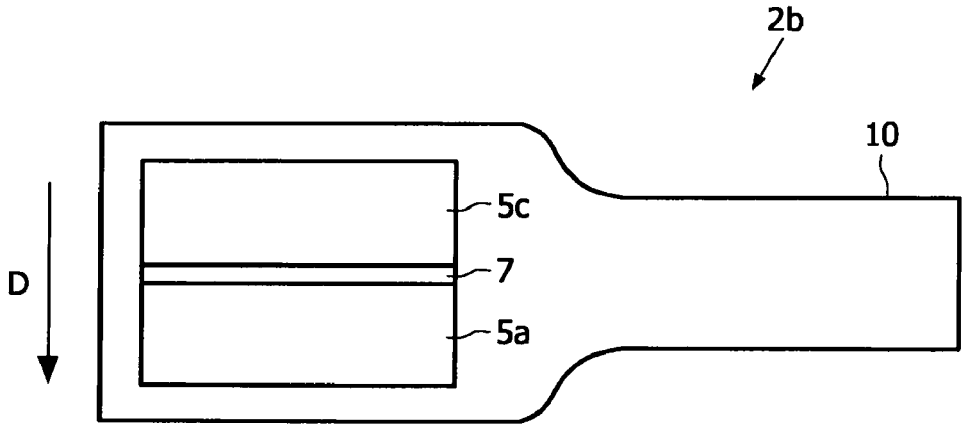

FIG. 1*b* shows a schematic top view of the lower clamping member 2*b* of the straightener 1. As the arrangement of the upper clamping member 2*a* is equivalent, everything said with respect to the lower clamping member 2*b* is valid as well for the upper clamping member 2*a*.

Seen in direction D of operation, platen 5*c* covering the cooling member of the lower clamping member 2*b* is arranged behind of the platen 5*a* covering the heating member. After introducing the hair between both clamping members 2*a,b* of the straightener 1, and clamping them between both clamping members 2*a,b*, the straightener is slowly pulled away from the head in direction D. By doing this, the hair is heated and flattened by platens 5*a,b* and subsequently cooled by platen 5*c* and its counterpart of the upper clamping member 2*a*. Additionally, the hair is further flattened by both platens of the cooling members.

Typical temperatures for heating the hair are ca. 80° C. to 250° C., depending on the hair quality sometimes ca. 100° C. to 300° C. Typical temperatures of the cooling members or of the platens in thermal contact with them can be as low as −10° C. to 20° C. Rapidly cooling the hair immediately after heating it, prevents hair damage due to over-heat and moisture loss. It keeps the lock of hair in question cool and ready a next styling cycle, if needed, without waiting for the hair to cool down by natural means. Compared to styling without subsequent active cooling, where the straightening or styling effect lasts only a few hours, it lasts several hours by using a hair styling appliance according to the present invention.

The end of the clamping member 2*b* opposite to the platens 5*a,c* is tapered to form a handle 10 easier to grip.

The platens 5*a, c* are separated by a thermal insulating member 7 for an improved and more energy-efficient operation of the straightener 1. Whereas the platens 5*a,c* are made of material with a high thermal conductivity, the insulating member 7 should be made of a material with a low thermal conductivity. The thermal conductivity of the platens 5*a, c* should not be too high to permit a homogeneous temperature distribution over the whole surface, especially, if the heating member or cooling member have an inhomogeneous temperature distribution, in case of heating e.g., if heat is provided by electric energy dissipation in a wound wire. Preferred materials for platens are ceramics.

Figure 1C:
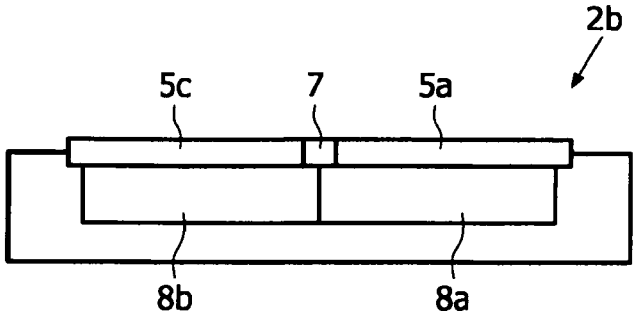

FIG. 1*c* shows schematically a cut through the lower clamping member 2*b*. The platens 5*a,c* are partly embedded into the clamping member 2*b* for better fixation. They are in immediate thermal contact with the heating member 8*a* and the cooling member 8*b*. In the present example illustrated in FIG. 1*c*, the heating member and the cooling member are made of a TEC, the cold side 8*b* of the TEC being the cooling member and the hot side 8*a* of the TEC being the heating member. This allows for a particularly compact and energy-efficient design. Besides, TECs permit for controllable heating and cooling rates, if wished. They may be provided in various sizes and with various maximum temperature differences.

Figure 2:
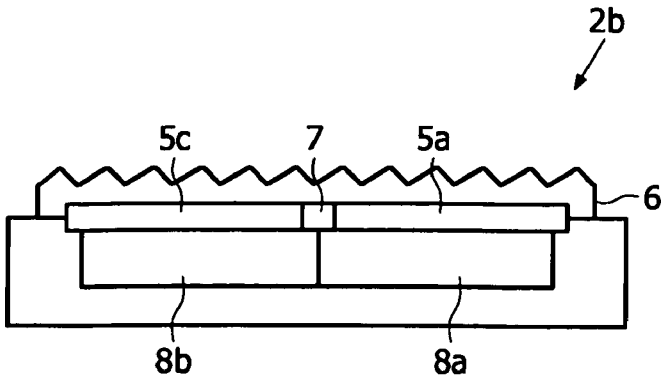
FIG. 2 shows a schematic cut through the clamping member of a hair crimper.

The clamping member 2*b* of FIG. 2 has in addition a styling member 6 arranged over the platens 5*a,c* for crimping the hair. The styling member 6 in the present example is removable to allow for crimping and straightening with the same hair styling appliance 1. The styling member 6 may be exchanged with other styling members permitting other kinds of crimping.

When fixing styling members over platens, the thermal conductivity of the styling members' and eventually the platens' material should preferably be particularly high. In other embodiments, no platens are used, but only styling members to be fixed on the heating and cooling members and in thermal contact with them. For straightening, the styling members have flat surfaces.

FIG. 3 shows schematically a hair curler 1'. The hair curler 1' has a fixed clamping member 2'*a* with two cooling members 4'*a* and 4'*b* and a round cross-section, and a moveable clamping member 2'*b* with two heating members 3'*a* and 3'*b* and a curved shape complementary to the shape of the fixed clamping member 2'*a*. For curling the hair, a lock of hair is wound around the fixed clamping member 2'*a* and clamped by pivoting the moveable clamping member 2'*b* against the fixed clamping member 2'*b*. Then, the hair curler 1' is pulled away from the head in direction D. By doing so, the lock of hair is first heated by heating member 3'*a*, then cooled by cooling member 4'*a*, again heated by heating member 3'*b* and subsequently cooled by cooling element 4'*b*. Simultaneously, the lock of hair is continuously pressed into a curl.

The lower end of the hair curler 1' can be used as handle 10. A switch 14 for controlling the cooling rate as well as a switch 15 controlling the heating rate are provided in the handle 10. The heating and cooling rates can be adjusted depending on the quality of the hair and the desired styling effect.

It will be noted that there could be provided a second moveable clamping member facing the present moveable clamping member 2'*b* to completely surround the wound hair lock during clamping. It is also possible to provide different upper ends with cooling members of the fixed clamping member 2'*a* with various radii and appropriate moveable clamping members to permit for various kinds of curling.

FIGS. 4*a,b,c* show schematically different possibilities to realize cooling members. The embodiment of FIG. 4*a* uses Peltier elements 11*a,b,c,d* for cooling. They are covered by curved platen 5'*a* to homogenize the temperature distribution at the outer surface in contact with the hair to be styled, and to provide the fixed clamping member 2'*a* with a shape appropriate for curling hair. On the inner side of the Peltier elements 11*a,b,c,d* space is provided to accommodate means for power supply and removal of heat.

Figure 4B:
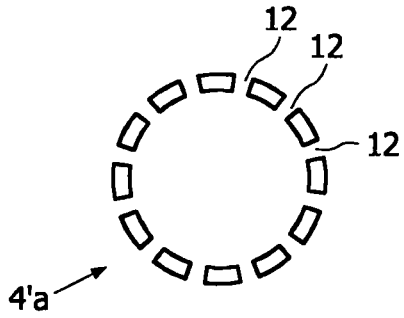

The cooling member 4'*a* shown in FIG. 4*b* is based on convection and cools the hair by blowing air of a lower temperature than the heating members through the openings 12.

Figure 4C:
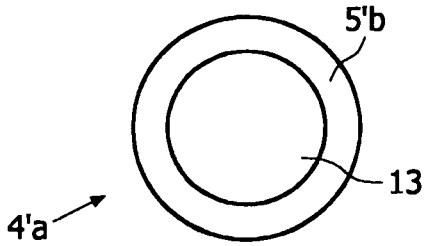

The cooling member 4'*a* shown in FIG. 4*c* utilizes a heat sink 13 surrounded by a cylindrical platen 5'*b*. As heat sink 13 one could use e.g. a copper rod or a fluid streaming along the inner side of the platen 5'*b*.

Whereas a cooling member based on the Peltier effect permits easily to control the cooling rate, this possibility is somehow reduced, when cooling with air or a heat sink.

A schematic view of the moveable clamping member 2'*b* is shown in FIG. 5. The main component of the heating members 3'*a,b* is a wound wire 17, producing heat by dissipating electric energy. Instead of using wires, one could use conductive structures applied by printing, photolithography, or evaporation etc. The wires or conductive structure may be covered by a thin platen.

In between the heating elements 3'*a,b* zones with openings 16 may be arranged in case of air cooling to let the cooling air escape.

Although having described several preferred embodiments of the invention, those skilled in the art would appreciate that various changes, alterations, and substitutions can be made without departing from the spirit and concepts of the present invention. The invention is, therefore, claimed in any of its forms or modifications with the proper scope of the appended claims. For example various combinations of the features of the following dependent claims could be made with the features of the independent claim without departing from the scope of the present invention. Furthermore, any reference numerals in the claims shall not be construed as limiting scope.

LIST OF REFERENCE NUMERALS

| | |
|---|---|
| 1 | straightener |
| 1' | curler |
| 2a,b | clamping member |
| 2'a,b | clamping member |
| 3 | heating member |
| 3'a,b | heating member |
| 4 | cooling member |
| 4'a,b | cooling member |
| 5a,b,c | platen |
| 5'a,b | platen |
| 6 | styling member |
| 7 | insulating member |
| 8a | hot side of a TEC |
| 8b | cold side of a TEC |
| 9 | lead |
| 10 | handle |
| 11a,b,c,d | Peltier element |
| 12 | opening |
| 13 | heat sink |
| 14 | cooling switch |
| 15 | heating switch |
| 16 | opening |
| 17 | heating wire |
| D | direction of operation |

The invention claimed is:

1. A hair styling appliance with clamping members, at least one clamping member of the clamping members comprising a heating member having a heating surface in a contact plane, for clamping hair to be styled and pulling the hair away in an operating direction along the contact plane, wherein the at least one clamping member further comprises a cooling member having a cooling surface in the contact plane, and wherein the cooling member is provided, seen in the operating direction, behind the heating member so that the hair is first heated by the heating member and subsequently cooled by the cooling member and the cooling member is a cold side of a first thermal electric cooler and the heating member is a hot side of a second thermal electric cooler.

2. The hair styling appliance according to claim 1, wherein the at least one clamping member comprises more than one heating member and/or one cooling member.

3. The hair styling appliance according to claim 1, wherein the cooling member comprises a Peltier element.

4. The hair styling appliance according to claim 1, wherein the at least one clamping member comprises a platen being in thermal contact with the cooling member and/or the heating member.

5. The hair styling appliance according to claim 1, wherein the at least one clamping member comprises a styling member.

6. The hair styling appliance according to claim 1, wherein the cooling member has a controllable cooling rate.

7. The hair styling appliance according to claim 1, wherein the heating member and the cooling member are separated by an insulating member.

* * * * *